US007201097B2

(12) United States Patent
De Koning

(10) Patent No.: US 7,201,097 B2
(45) Date of Patent: Apr. 10, 2007

(54) DIAPHRAGM PUMP

(75) Inventor: Cornelis Johannes De Koning, Ph Venlo (NL)

(73) Assignee: Weir Minerals Netherlands B.V., Venlo (NL)

( * ) Notice: Subject to any disclaimer, the term of this patent is extended or adjusted under 35 U.S.C. 154(b) by 15 days.

(21) Appl. No.: 10/520,634

(22) PCT Filed: Jul. 4, 2003

(86) PCT No.: PCT/NL03/00497

§ 371 (c)(1),
(2), (4) Date: Sep. 21, 2005

(87) PCT Pub. No.: WO2004/007961

PCT Pub. Date: Jan. 22, 2004

(65) Prior Publication Data

US 2006/0110268 A1 May 25, 2006

(30) Foreign Application Priority Data

Jul. 11, 2002 (NL) ..... 1021048

(51) Int. Cl.
*F04B 17/00* (2006.01)

(52) U.S. Cl. ..... 92/92; 92/98 R; 417/413.1

(58) Field of Classification Search ..... 417/413.1; 92/92, 96, 98 R, 99, 101
See application file for complete search history.

(56) References Cited

U.S. PATENT DOCUMENTS

| | | | | |
|---|---|---|---|---|
| 2,405,734 A | | 8/1946 | Coe | 103/44 |
| 3,416,461 A | | 12/1968 | McFarland | 103/150 |
| 4,212,589 A | * | 7/1980 | Bosio | 128/124.1 |
| 4,416,599 A | * | 11/1983 | De Longchamp | 417/386 |
| 5,620,746 A | | 4/1997 | Snyder, Jr. | 427/282 |
| 6,234,677 B1 | | 5/2001 | Mogil | 383/110 |

FOREIGN PATENT DOCUMENTS

| | | |
|---|---|---|
| BE | 502350 | 7/1952 |
| EP | 0524820 A2 | 1/1993 |
| FR | 2164025 | 7/1973 |

* cited by examiner

*Primary Examiner*—Igor Kershteyn
(74) *Attorney, Agent, or Firm*—Jacobson Holman PLLC

(57) ABSTRACT

The invention relates to a diaphragm pump for pumping aggressive and/or abrasive media, such as slurries, comprising a diaphragm housing mounted in a substantially vertically disposed pipe system, which substantially vertically disposed pipe system comprises at least one inlet and at least one outlet positioned some distance above the inlet, as well as at least one substantially circular, flexible diaphragm, which diaphragm is movable within the diaphragm housing under the influence of a working liquid to be pressurised, in which the circular outer edge of the diaphragm is clamped down in the diaphragm housing by means of a circular clamping member. According to the invention, the diaphragm pump is characterized in that the circular clamping member is provided, on the circumferential edge thereof, with a flange that extends parallel to the plane formed by the clamping member. Since the circular clamping member is provided with a flange extending in the plane formed by the clamping member, disadvantageous deformation of the diaphragm during the delivery stroke will be prevented, because the deforming diaphragm will come to abut against the flange.

11 Claims, 4 Drawing Sheets

DIAPHRAGM PUMP

This is a nationalization of PCT/NL03/000497 filed Jul. 4, 2003 and published in English.

FIELD OF THE INVENTION

The invention relates to a diaphragm pump for pumping aggressive and/or abrasive media, such as slurries, comprising a diaphragm housing mounted in a substantially vertically disposed pipe system, which substantially vertically disposed pipe system comprises at least one inlet and at least one outlet positioned some distance above the inlet, as well as at least one substantially circular, flexible diaphragm, which diaphragm is movable within the diaphragm housing under the influence of a working fluid that can be pressurised, with the circular outer edge of the diaphragm being clamped down in the diaphragm housing by means of a circular clamping member.

Such a diaphragm pump is known, for example from U.S. Pat. No. 6,234,677, and pumps of this kind are generally used in pump systems for pumping aggressive and/or abrasive media, which may or may not have a high temperature, such as slurries. The known diaphragm pump has an elastically movable diaphragm, which separates the medium to be pumped from the moving and vulnerable parts of the pump. The pumping motion of the flexible diaphragm is effected by means of the moving parts, such as a piston that moves within a cylinder and a working fluid that can be pressurised.

To this end the piston, which is connected to a driving unit by means of a piston rod, is reciprocated within the cylinder, so that the diaphragm will carry out successive suction and delivery strokes at a particular frequency under the influence of the working fluid. An underpressure is generated in the diaphragm housing during the suction stroke or the suction period, so that a certain amount of slurry can be taken in via the inlet, which amount of slurry is forced into a discharge pipe via the outlet by the diaphragm during the delivery stroke.

In order to ensure the correct functioning of the suction stroke and the delivery stroke, one-way valves are mounted in the inlet pipe portion and in the outlet pipe portion, respectively, which valves guarantee a correct through-flow of the medium to be pumped.

The diaphragm pump of the aforesaid US Patent is mounted in a dead pipe portion of the pipe system, which application is very suitable for pumping slurries having a relatively high temperature. In the case of slurries having a lower temperature, it is less essential to protect the diaphragm pump from said hot, corrosive slurries, and the diaphragm pump may be mounted in the pipe system as mentioned in the introduction. For constructional reasons, the pipe system is disposed vertically, with the inlet being positioned below the outlet.

It has become apparent that hydrodynamic phenomena occur in the slurry within the diaphragm housing during operation of the diaphragm pump, which phenomena cause sufficiently large pressure differences between positions at the top of the diaphragm housing and positions at the bottom of the diaphragm housing, resulting in a disadvantageous deformation of the flexible diaphragm, in particular during the delivery stroke.

Said disadvantageous deformations of the flexible diaphragm place a limit on the extent to which the diaphragm can be loaded, which makes it necessary to select a larger diaphragm when the suction stroke volume has a particular value, so as to ensure a sufficiently long life.

The object of the invention is to provide a solution for the above problem and to provide a diaphragm pump in which the asymmetrical deformation of the diaphragm during operation is limited where necessary, so that the deformation of the diaphragm will increase elsewhere without this leading to an overload. Thus the output capacity of a selected diaphragm dimension will be maximally utilised whilst obtaining an optimum life span.

A diaphragm pump as described above is also disclosed in U.S. Pat. Nos. 3,416,461. 2,405,734. 5,620,746, Belgian Patent No.502,350, European Patent Application No. 0,524, 820 and French Patent No. 2,164,025. In these listed patent publications diaphragm pumps are disclosed having a circular shaped, flexible diaphragm movable accommodated in a housing. The diaphragms are each clamped down with their circular outer edge in the diaphragm housing by means of a circular shaped clamping member.

The clamping members as used in these listed patent publications exhibit a symmetrical circular shape still resulting in an a-symmetric deformation of the clamped diaphragm during use.

SUMMARY OF THE INVENTION

According to the invention, the diaphragm pump is to that end characterized in that the circular clamping member is provided, on the circumferential edge thereof, with a flange that extends parallel to the plane formed by the clamping member.

Since the circular clamping member is provided with a flange that extends in the plane formed by the clamping member, said disadvantageous deformation of the diaphragm during the delivery stroke will be prevented, because the deforming diaphragm will come to abut against the flange.

It has been established by experiment that the disadvantageous deformation of the diaphragm during the delivery stroke occurs in particular at the location of the outlet of the pipe system, so that according to the invention the circular clamping member is provided with said projecting flange substantially at the location of the outlet of the pipe system.

According to the invention, the projecting flange is provided along the upper half of the circumferential edge of the clamping member so as to prevent the disadvantageous deformation of the diaphragm in the upper part thereof as much as possible.

According to the invention, the length of the projecting flange varies along the upper half of the circumferential edge, because also the extent of the disadvantageous deformation of the diaphragm varies in dependence on the position thereof within the diaphragm housing. More in particular, the length of the projecting flange is greatest near the outlet, because the disadvantageous deformation of the diaphragm that occurs during the delivery stroke is greatest at that location, and consequently is to be counteracted most at that location.

According to the invention, the length of the projecting flange substantially equals zero in the middle of the circumferential edge.

According to the invention, the end edge of the projecting flange is curved so as to prevent the projecting flange cutting into the diaphragm, which might result in the diaphragm being cut and damaged. The radius of curvature of the end edge may be approximately equal to the thickness of the diaphragm, more in particular, the curvature of the end edge will be approximately equal to the counter curvature of the preformed diaphragm. Thus the diaphragm material is prevented from being damaged yet when the diaphragm abuts against the projecting flange, which damage might shorten the life of the diaphragm yet.

More specifically, the radius of curvature of the end edge ranges from 8 to 80 mm.

The curvature may also exhibit the form of a second or higher degree polynomial, which can be calculated by means of the aforesaid radii of curvature.

DETAILED DESCRIPTION OF THE INVENTION

Figure 1:
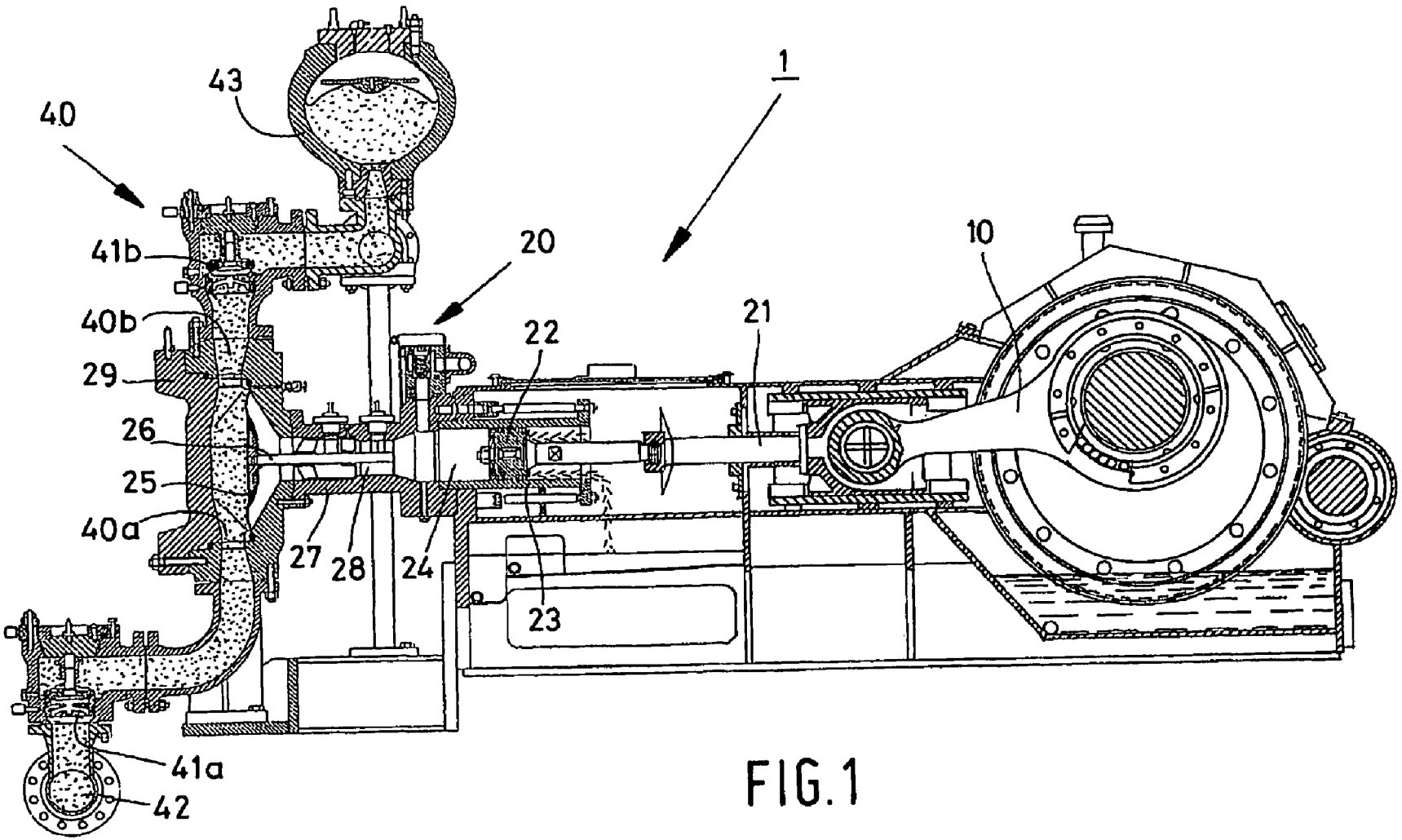
FIG. 1 is an outline drawing of a pump system for pumping slurries, in which a prior art diaphragm pump is used.
Figure 2:
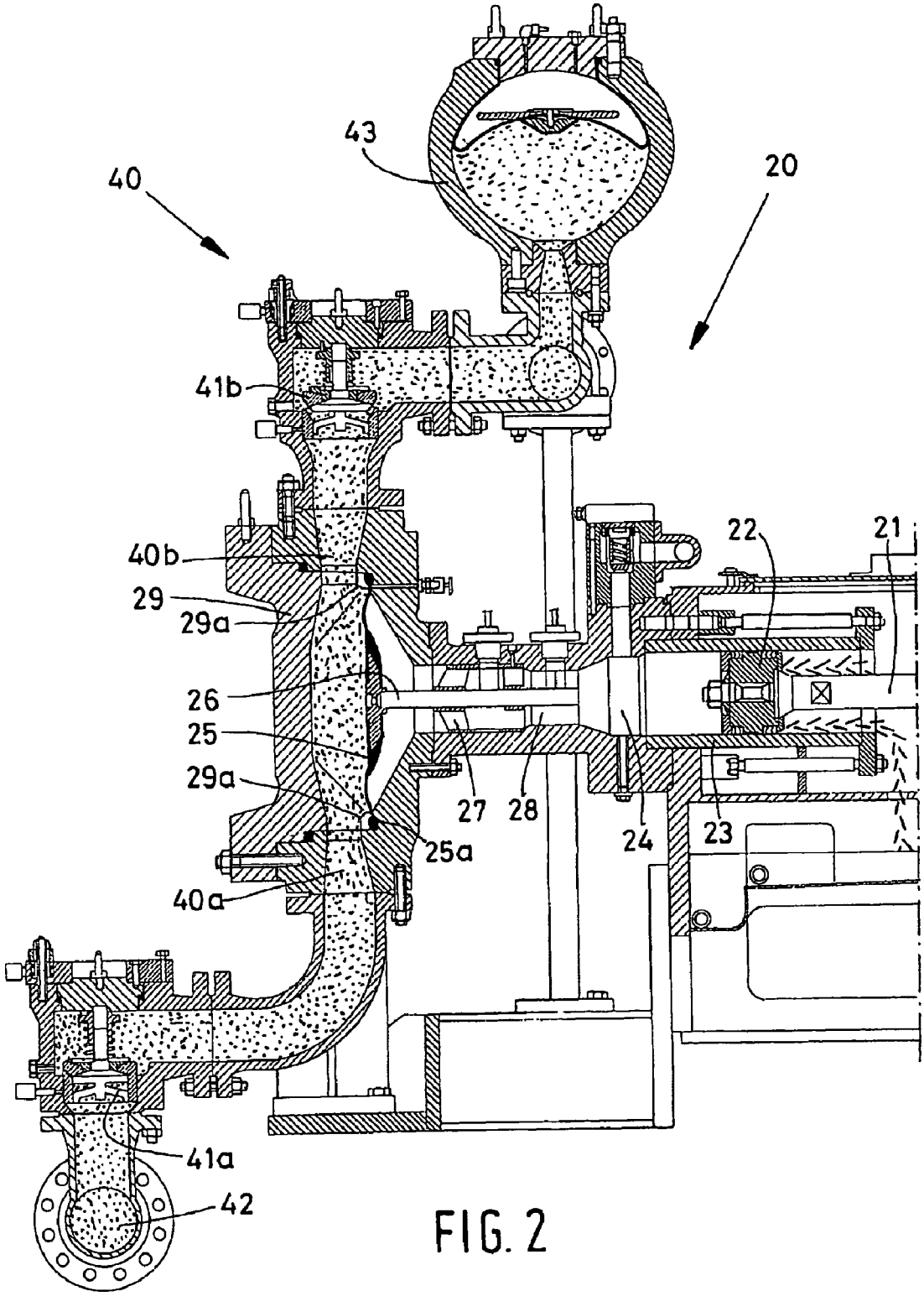
FIG. 2 is a view of a detail of FIG. 1.

FIGS. 1 and 2 are views of a slurry pump system, in which a prior art diaphragm pump is used. Such slurry pump systems are used for pumping generally aggressive and corrosive liquids or slurries containing granular material such as sand, coal, ore or mining waste, which in addition sometimes have high temperatures, over generally large distances. Such slurry pump systems are furthermore commonly used in the mineral mining industry, the chemical industry and the coal industry. The pumping of such mixtures, also known as slurries, makes heavy demands on the reliability and the wear-resistance of the overall pump system. Because of the abrasive nature of the slurry mixtures, in particular the moving components of the pump must meet very stringent requirements.

Consequently, a diaphragm pump 20 driven by a driving unit 10 is used for pumping such abrasive slurry mixtures. The diaphragm pump 20 consists of a diaphragm 25 which is clamped down in a diaphragm housing 29 mounted in a pipe system 40. The diaphragm 25 is provided with a diaphragm rod 26, which is movably accommodated in guides 27 disposed in a pressure chamber 28. The pressure chamber 28 is filled with a working fluid 24, which can be pressurised by means of a piston 22 that is connected to the driving unit 10 by means of a piston rod 21. The reciprocating movement of the piston 22 within the cylinder 23 effected by the driving unit 10 leads to the working fluid 24 being pressurised and consequently to the diaphragm 25 being moved between two extreme positions in the diaphragm housing 29.

The reciprocating movement of the piston 23 and the resulting movement of the diaphragm 25 comprises a suction stroke or suction period, in which the piston 23 and the diaphragm 25 undergo a movement to the right, seen in FIGS. 1 and 2, whilst the piston 23 and the diaphragm 25 undergo a movement to the left, seen in FIGS. 1 and 2, during the delivery stroke.

The diaphragm housing 29 is mounted in a substantially vertically disposed pipe system 40 that forms part of a more extensive network of pipes (not shown). The vertically disposed pipe system 40 of the diaphragm housing 29 comprises an inlet 40*a* as well as an outlet 40*b*. Mounted in the inlet pipe portion 42 is a one-way valve 41*a*, whilst a similar one-way valve 41*b* is mounted in the outlet pipe portion 43. The one-way valve 41*a* and 41*b* are mounted in the pipe system in such a manner that the one-way valve 41 remains closed during the suction stroke (when the diaphragm 25 moves to the right, therefore), whereas the one-way valve 41*a* opens during said suction stroke, thus enabling the intake of a certain amount of slurry into the diaphragm housing 29. During the subsequent delivery stroke (when the diaphragm 25 moves to the left, therefore), the one-way valve 41*a* automatically closes under the influence of the action of a spring and the one-way valve 41*b* automatically opens under the influence of the delivery pressure, so that the amount of slurry that has collected in the diaphragm housing 29 is forced into the discharge pipe 43 via the outlet 40*b*.

Large amounts of slurry can be pumped, usually under high pressures, when the diaphragm pump is driven with a desired stroke frequency in this manner.

The function of the diaphragm as the displacement element will be apparent: the diaphragm screens all the moving parts, which parts are liable to wear, therefore, from the abrasive and frequently also corrosive medium that is present in the vertical pipe portion 40.

It has been found that hydrodynamic effects occur in the slurry mixture flowing through the diaphragm housing 29, in particular during the delivery stroke, when a vertically disposed pipe portion 40 whose inlet 40*a* is positioned under the outlet 40*b* is used, which hydrodynamic effects lead to pressure differences between the bottom side 40*a* and the upper side 40*b* of the diaphragm housing. Said pressure differences are in particular generated because the outlet 40*b* forms a throttled pipe portion compared to the large passage in the diaphragm housing near the centre of the diaphragm, as a result of which said pipe portion functions as a venturi, and the slurry mixture is forced through the outlet 40*b* from the diaphragm housing 29 at a high velocity, especially during the middle part of the delivery stroke, when the sinusoidal velocity curve of the piston 23 reaches its peak. Said high velocities at the outlet 40*b* lead to a reduced pressure at the location of the outlet 40*b* compared to the rest of the diaphragm 25, and consequently to a corresponding disadvantageous deformation of the diaphragm 25.

Furthermore, an increasing static pressure difference acts on the diaphragm from the top to the bottom as a result of the difference in the specific weight of the slurry mixture and that of the working fluid.

Figure 3:
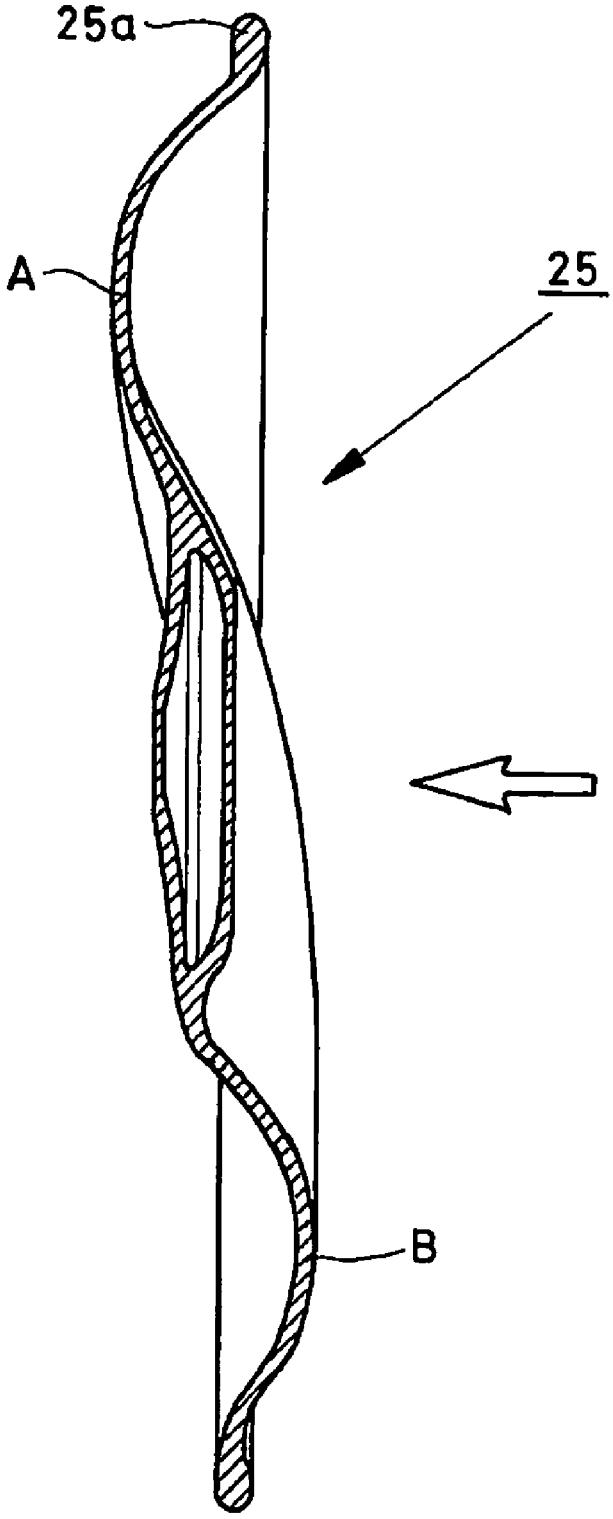
FIG. 3 is an instantaneous view of the disadvantageous deformation of the diaphragm, in particular during a delivery stroke.

FIG. 3 shows an instantaneous view of the disadvantageous deformation of the diaphragm 25, in particular during the delivery stroke. The Figure clearly shows that the diaphragm 25 moves out or deforms extremely into the diaphragm housing 29 (indicated at A) at the location of the outlet 40*b* (FIGS. 1 and 2) as a result of the pressure created by the slurry mixture flowing through the outlet 40*b*, which thus "sucks along" the diaphragm at the location of the outlet 40*b*. The Figure furthermore shows a less distinct deformation B at the bottom side 40*a*. It will be understood that in the long run such extreme deformations of the diaphragm 25 will lead to fatigue or damage and consequently will considerably reduce the life of the diaphragm. This means that the pump system 1 must be put out of operation at regular intervals for inspection and possible maintenance.

Figure 4:
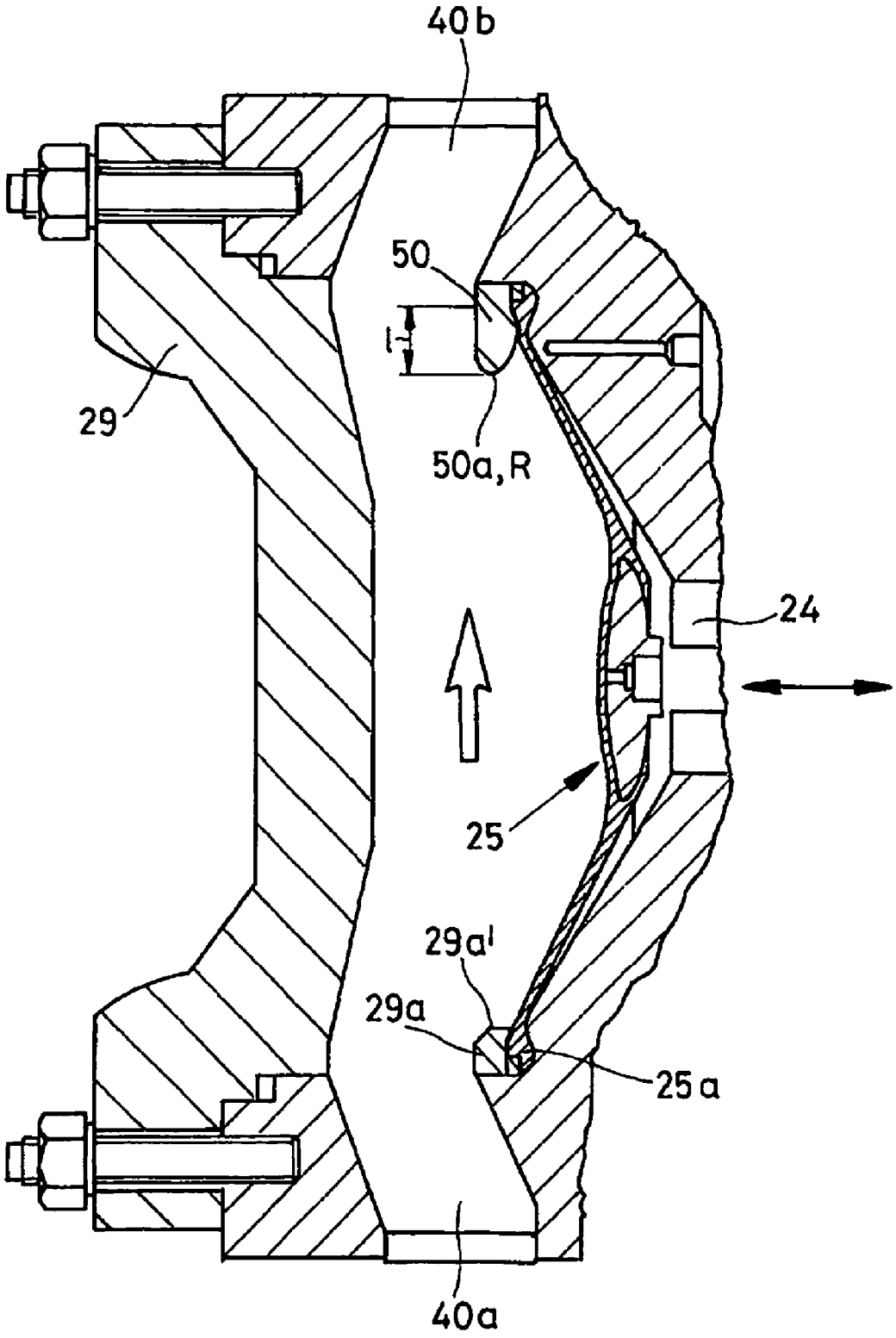
FIG. 4 shows an embodiment of a detail of a diaphragm pump according to the invention.

In order to prevent unnecessary standstill and provide a diaphragm pump having a longer life, in which the diaphragm is less liable to fatigue or wear caused by the disadvantageous deformation that occurs during operation, FIG. 4 shows a solution which can prevent said disadvantageous deformation.

As FIGS. 1 and 2 show, the diaphragm 25 is circular in shape and has a circular end edge 25*a*, which is clamped down in the diaphragm housing 29 by means of a ring-shaped clamping member 29*a* (see FIG. 2). In order to prevent unnecessary asymmetrical deformation of the diaphragm 25, in particular during the delivery stroke action of the diaphragm pump, the circular clamping member 29*a* is provided with a projecting flange 50 on its circumferential edge 29*a*' substantially at the location of the outlet 40*b* of the diaphragm housing 29, which flange extends parallel to the plane or in the plane formed by the clamping member.

The provision of a projecting flange around the circumferential edge of the circular clamping member, and more in particular near or at the location of the outlet 40*b* of the diaphragm housing 29, prevents disadvantageous deformation, and more in particular extreme deformation into the diaphragm housing 29 of the diaphragm 25. The diaphragm 25 is supported on the projecting flange 50 of the circular clamping member 29*a* at the location of the outlet 40*b* during the delivery stroke, thus preventing disadvantageous, undesirable deformation of and damage to the diaphragm material 25.

As FIG. 4 shows, the projecting flange 50 is provided along the upper half of the circumferential edge of the clamping member.

Although the projecting flange may also be provided along the lower half of the circumferential edge of the clamping member 29*a*, i.e. near the inlet 40*a*, it has been found that the disadvantageous deformation of the diaphragm 25 manifests itself mainly at the location of the outlet 40*b* of the diaphragm housing 29. During the delivery stroke, the one-way valve 41*b* in the outlet pipe portion 43 of the pipe system 40 opens (whereas the one-way valve 41*a* in the inlet portion 42 of the pipe system 40 closes), and the amount of slurry mixture that has collected in the diaphragm housing 29 is forced through the narrowing throat of the outlet 40*b* under a high pressure by the piston 23 via the working fluid 24 and the diaphragm 25.

The throat of the outlet 40*b* functions as a venturi during said flow, so that high flow velocities of the slurry mixture are created in the throat. This hydrodynamic phenomenon results in a pressure decrease at the outlet 40*b*, and consequently in an extreme deformation of the diaphragm 25 at the location of the outlet 40*b* (see FIG. 3). This extreme deformation is prevented in large measure by the projecting flange 50. The life of the diaphragm is thus significantly prolonged, since the diaphragm is no longer subjected to repeated extreme deformation, which usually accelerates the ageing process of the diaphragms 25, which are generally made of a rubber.

In accordance with one embodiment as shown in FIG. 4, the length 1 of the projecting flange varies along the circumferential edge. More in particular, the length of the projecting flange is greatest near the outlet 40*b*, whilst it equals zero in the middle of the circumferential edge 29*a*'. More in particular, the projecting flange 50 coincides with the circumferential edge 29*a*' near the middle of the clamping member 29*a* (seen in the direction of flow from the inlet 40*a* to the outlet 40*b*).

Since the diaphragm 25 comes to abut against the projecting flange 50 with each delivery stroke during operation, the end edge 50*a* of the projecting flange 50 has a curvature R, in order to prevent the edge cutting into the flexible diaphragm 25. More in particular, the radius of curvature R of the end edge 50*a* is proportional to the thickness of the diaphragm 25, and in another embodiment the radius of curvature R of the end edge 50*a* is proportional to the counter curvature of the preformed diaphragm 25, and that in such a manner that the amount of stretch occurring upon deflection is sufficiently low to achieve the desired life span.

It has been found that if the radius of curvature of the end edge 50*a* ranges from 8 to 80 mm, said edge is prevented from cutting into the diaphragm, as a result of which the life of the diaphragm 25 is further prolonged.

It is furthermore noted that it is preferred not to provide the projecting flange 50 on the lower half of the circumferential edge 29*a*' of the clamping member 29*a*, since this may lead to slurry mixture accumulating between the flange and the diaphragm 25, which may cause damage to the diaphragm.

The invention claimed is:

1. A diaphragm pump for pumping aggressive and/or abrasive media, comprising a diaphragm housing mounted in a substantially vertically disposed pipe system, which substantially vertically disposed pipe system comprises at least one inlet and at least one outlet positioned some distance above the inlet, as well as at least one substantially circular, flexible diaphragm having a circular outer edge, which diaphragm is movable within the diaphragm housing under the influence of a working liquid which is pressurised, with the circular outer edge of the diaphragm being clamped down in the diaphragm housing by means of a circular clamping member, wherein said clamping member defines a circular plane, characterized in that the circular clamping member is provided, on its circumferential edge, with a flange that extends parallel to the plane formed by the clamping member.

2. A diaphragm pump according to claim 1, characterized in that the circular clamping member is provided with said projecting flange substantially at the location of the outlet of the pipe system.

3. A diaphragm pump according to claim 1, characterized in that the projecting flange is provided along the upper half of the circumferential edge of the clamping member.

4. A diaphragm pump according to claim 3, characterized in that the length of the projecting flange varies along the upper half of the circumferential edge.

5. A diaphragm pump according to claim 4, characterized in that the length of the projecting flange is greatest near the outlet.

6. A diaphragm pump according to claim 4, characterized in that the length of the projecting flange substantially equals zero in the middle of the circumferential edge up to about 30° below the middle of the circumferential edge.

7. A diaphragm pump according to claim 1, characterized in that an end edge of the projecting flange is curved.

8. A diaphragm pump according to claim 7, characterized in that the radius (R) of curvature of the end edge is approximately equal to the thickness of the diaphragm.

9. A diaphragm pump according to claim 7, characterized in that the curvature of the end edge is proportional to the counter curvature of a preformed diaphragm.

10. A diaphragm pump according to claim 7, characterized in that the radius of curvature of the end edge ranges from 8 to 80 mm.

11. A diaphragm pump according to claim 10, characterized in that the curvature of the end edge extends accordance to a second or higher degree polynomial.

* * * * *